United States Patent [19]

Fischer

[11] 4,267,906

[45] May 19, 1981

[54] SLIDING CONTACT FOR A TOY TRAIN

[76] Inventor: Artur Fischer, Weinhalde 34, 7244 Waldachtal 3, Tumlingen, Fed. Rep. of Germany

[21] Appl. No.: 115,294

[22] Filed: Jan. 25, 1980

[30] Foreign Application Priority Data

Feb. 19, 1979 [DE] Fed. Rep. of Germany ..... 2906309

[51] Int. Cl.[3] ..... B60L 5/38

[52] U.S. Cl. ..... 191/49; 191/59.1; 46/260

[58] Field of Search ..... 191/47, 49, 59.1; 46/260, 257–259

[56] References Cited

U.S. PATENT DOCUMENTS 3,231,987 2/1966 Schott ..... 46/260 X 3,760,128 9/1973 Charamel ..... 191/49

*Primary Examiner*—Richard A. Schacher

*Attorney, Agent, or Firm*—Michael J. Striker

[57] ABSTRACT

A sliding contact for collecting current from a two-rail track system of a toy railroad to a toy train, has a holding plate, two contact pins mountable on the toy train by the holding plate and arranged to be located above the rails, and a sliding bridge which engages with the contact pins so as to allow lateral movement between the latter and the former, and is arranged to slide along both rails of the track system and to maintain electrical connection between the rails and the contact pins. The sliding bridge may be provided with guiding elements for guiding the sliding bridge during its sliding along the rails.

12 Claims, 3 Drawing Figures

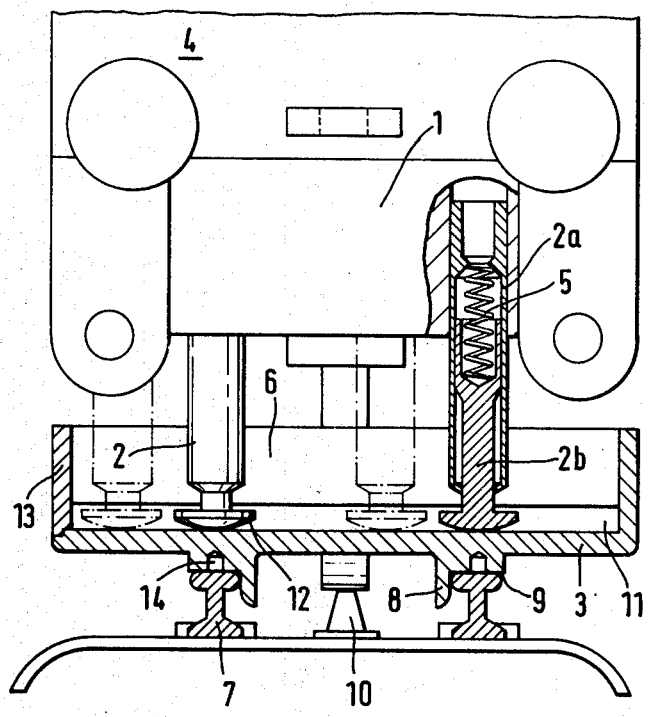
FIG. 1
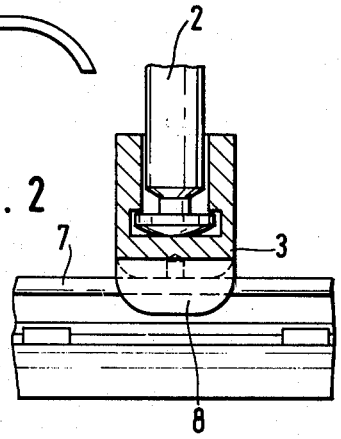
FIG. 2
FIG. 3
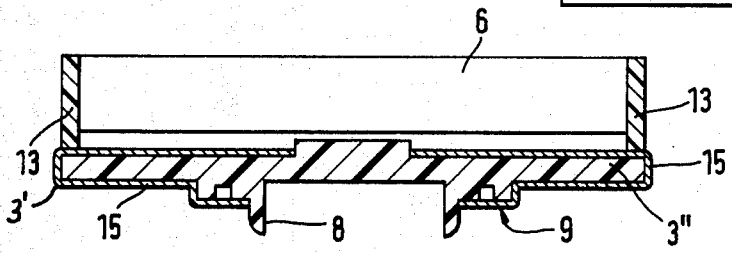

SLIDING CONTACT FOR A TOY TRAIN

BACKGROUND OF THE INVENTION

The present invention relates to a sliding contact for a toy train, for collecting current from a two-rail track system of a toy railroad.

A sliding contact of the above-mentioned general type is known in the art. A known sliding contact includes a holding plate which mounts two contact pins on a toy train so that each contact pin is located above a respective one of the rails of a two-rail track system. The current collection from the rails in toy trains is generally performed through the wheels which either completely consist of electrically conductive material or at least the wheel rim consists of such a material. The current is then collected from the wheels via sliding contacts and supplied to the drive of the toy train. In order to make possible running of the toy train over switch points, at least two pairs of wheels are necessary for current collection. Since the metal contact of the wheels on the rails is provided, no rolling friction takes place which leads to the slippage of the wheels on the rail even in condition of small loads. In light-weight toy trains including synthetic plastic components, it is therefore customary to make the wheels of synthetic plastic material and to provide the latter with a rubber ring which increases the rolling friction. However, such wheels cannot be utilized for collecting the current. For this reason, the current collection in the known toy trains is carried out via contact pins which are mounted on the toy train by means of a holding plate and directly slide over the rails. Since the contact pins are rigidly connected with the toy train, they move to a slight degree out of the rail rack when the train runs over track bends, track junctions, and switch points.

SUMMARY OF THE INVENTION

Accordingly, it is an object of the present invention to provide a sliding contact for a toy train which avoids the disadvantages of the prior art.

More particularly, it is an object of the present invention to provide a sliding contact for a toy train which makes possible reliable contacting with the rails without including the wheels in the process of contacting.

In keeping with these objects and with others which will become apparent hereinafter, one feature of the present invention resides, briefly stated, in a sliding contact which has two contact pins mounted on a toy train via a holding plate, and a sliding bridge engaged with the contact pins and arranged to slide along both traction rails so as to maintain electrical connection between the the rails and the contact pins.

In accordance with another feature of the present invention the sliding bridge is provided with a groove in which the end portions of the contact pins engage, and two guiding pins are arranged on the sliding bridge so as to rest on the inner surfaces of the rails and to thereby guide the sliding bridge during its movement over the rails.

Since the contact pins engage in the groove in the sliding bridge, it moves over both rails of the track system. At the same time, the lateral movement takes place between the contact pins and the sliding bridge, without interrupting the electrical connection between the rails and the contact pins via the sliding bridge. The contact pins which move out of the line of the track system on bends, junctions and switch points, remain electrically connected to the rails, because of the relative movement between the sliding bridge and the contact pins and the constant electrical connection of the contact pins to the rails through the sliding bridge. The constant contact of the sliding bridge with the rails is attained by the guiding pins which are arranged on the sliding bridge and rest on the inner surfaces of the rails. When the current supply is performed only through the two rails connected to a positive conductor and to a negative conductor, respectively, the sliding bridge must have two parts which are insulated from one another.

In accordance with still another feature of the present invention, the groove of the sliding bridge may have a T-shaped cross-section, and the end portions of the contact pins may be provided with beads which fit into the T-shaped groove. This construction makes possible the suspension of the sliding bridge on the contact pins.

In accordance with a further feature of the present invention, the groove of the sliding bridge has two ends which may be closed or closeable. This measure, in connection with the above-mentioned construction, provides for a connection between the contact pins and the sliding bridge, which prevents releasing of the sliding bridge from the contact pins, when the toy train is removed from the track system.

In accordance with still a further feature of the present invention, the sliding bridge may include an injection-molded synthetic plastic body part and a contact metal sheet which is in contact with the contact pins and extends to the sliding faces of the sliding bridge. The contact metal sheet establishes the electrical connection from the rails to the groove of the sliding bridge and thereby to the contact pins.

Finally, when the current is supplied not only through the rails but also through a central conductor, the sliding bridge may be arranged so as to electrically connect the contact pins with one another and provided with current-collecting means adapted to slide over the central conductor. In this construction the sliding bridge may be completely constituted of an electrically conductive material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a longitudinal section of the sliding contact in accordance with the present invention;

FIG. 2 is a view showing a transverse section of the sliding contact of FIG. 1; and FIG. 3 is a view showing a sliding contact in accordance with a further embodiment of the present invention.

DESCRIPTION OF THE PREFERRED EMBODIMENTS

A sliding contact of a toy train, for collecting current from a two-rail track system of a toy railroad includes a holding plate 1 and two contact pins 2 which are mounted on the toy train by the holding plate 1. The contact pins 2 have end portions which face away of the toy train and face toward rails 7. A sliding bridge 3 is fitted on the above-mentioned end portions of the contact pins 2.

The mounting plate 1 together with both contact pins 2 are mounted by mounting means on the toy train which is identified by reference numeral 4. In order to compensate for irregularities, each contact pin 2 is composed of two telescopically assembled parts 2*a* and 2*b*. One of these parts is pressed into the mounting plate 1, whereas the other part is movable relative to the first mentioned part with interposition of a spring 5 so as to compensate for differences in the height. The free end portions of the contact pins 2 or more particularly of their parts 2*b* are inserted in a groove 6 of the sliding pin 3.

The groove 6 is arranged so that it makes possible displacement of the contact pins 2 relative to the sliding bridge 3, without interrupting the electrical connection with the rails 7 via the sliding bridge 3. This transverse displacement takes place when the toy train runs over a bend, switch point or junction.

The sliding bridge 3 is provided with guiding pins 8 which rest on the inner surfaces of the rails 7 during movement of the toy train over the rails. Thereby, the sliding bridge 3 is always in contact with the rails 7. The transverse displacement of the pins 2 relative to the sliding bridge 3 does not interrupt the electrical connection of the pins toward the rails, inasmuch as the sliding bridge 3 is always in contact with the rails 7, on the one hand, and the pins 2 are always in contact with the sliding bridge 3, on the other hand. The constant contact of the sliding bridge 3 with the rails 7 is attained with the aid of the guiding pins 8.

FIG. 1 shows a toy railroad in which the current supply is performed not only via the two rails 7 having the same potential, but also via a central or middle conductor 10 located between the rails. In this case, the sliding bridge 3 connects the contact pins 2 to one another electrically and therefore may be constituted completely of an electrically conductive material, such as brass. At the same time, the sliding bridge 3 is provided with means for sliding in contact with the middle conductor 10. This means may be formed by a portion of the lower wall of the sliding bridge 3 or by an additional projection on the lower wall.

In order to allow the engagement of the sliding bridge with or the suspension of the sliding bridge on the contact pins 2, the groove 6 of the sliding bridge may have a T-shaped cross-section and the end portions of the contact pins 2 may be provided with beads 12 which has a cross-section corresponding to the cross-section of the T-shaped groove 6 and engage in an undercut of the latter. The insertion of the contact pins 2 into the groove 6 may be carried out from one of the open ends of the groove. The latter is closed after insertion, by means of an end plate 13. Each pin 2, or more particularly its part 2*b* has a sliding face 9 which is provided with a hole 14. When the toy train travels over the rails, an edge of the hole 14 scrapes off the dust settled on the rails 7. Furthermore, this hole prevents formation of a layer of dirt on the sliding face, which would lead to interruption in the current transmission.

A sliding contact in accordance with the embodiment shown in FIG. 3 has a sliding bridge which is identified by reference numeral 3' and includes an injection-molded body part 3'' constituted of a synthetic plastic material. The sliding bridge 3' further has two contact plates 15 which extend from sliding faces 9 of the sliding bridge and engages at both sides into the groove 6 of the sliding bridge. The contact plates 15 may be formed by metal sheets which are connected with the body part 3'' by riveting, glueing, and the like.

Since both contact plates 15 are separated from one another, the sliding contact in accordance with this embodiment is suitable for track systems in which the current supply is performed only via two rails, of which one rail is connected to a negative conductor whereas the other rail is connected to a positive conductor. Two end plates 13 are provided in this construction so as to close both open sides of the guide 6 of the sliding bridge 3'.

It will be understood that each of the elements described above, or two or more together, may also find a useful application in other types of constructions differing from the types described above.

While the invention has been illustrated and described as embodied in a sliding contact of a toy train, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sliding contact for a toy train, for collecting current from a two-rail track system of a toy railroad, comprising a holding plate; two contact pins mountable on the toy train by said holding plate, each of said contact pins being arranged to be located above one rail of a track system and having an end portion facing toward the same; a sliding bridge engaged with said contact pins so as to allow lateral movement of the latter relative to the former, said sliding bridge being arranged to slide along both rails of the track system and to maintain the electrical connection between the rails and said contact pins; and means for guiding said sliding bridge during its sliding along the rails.

2. A sliding contact as defined in claim 1, wherein said sliding bridge has a guiding formation, said end portions of said contact pins engaging with said guiding formation of said sliding bridge.

3. A sliding contact as defined in claim 2, wherein said guiding formation is a groove in which the end portions of both contact pins engage.

4. A sliding contact as defined in claim 1, wherein said guiding means includes two guiding pins provided on said sliding bridge and arranged to rest on the rails of the track system.

5. A sliding contact as defined in claim 4, wherein the rails of the track system have inner surfaces facing toward one another, each of said guiding pins being arranged to abut against the inner surface of a respective one of the rails.

6. A sliding contact as defined in claim 3, wherein said groove is T-shaped and each of said end portions of said contact pins is provided with a bead which corresponds to said T-shaped groove.

7. A sliding contact as defined in claim 3, wherein said groove has two spaced ends which are closed.

8. A sliding contact as defined in claim 3, wherein said groove has two spaced ends at least one of which ends is closable; and further comprising means for closing said one end of said groove.

9. A sliding contact as defined in claim 7, wherein the other of said ends of said groove is also closable; and further comprising means for closing said other end of said groove.

10. A sliding contact as defined in claim 3, wherein said sliding bridge has sliding faces and includes an injection-molded body portion of a synthetic plastic material, and a contact metal sheet which lines said grooves so as to be in contact with said end portions of said contact pins and to extend up to said sliding faces of said sliding bridge.

11. A sliding contact as defined in claim 1, wherein said sliding bridge is constituted of an electrically conductive material.

12. A sliding contact as defined in claim 11, wherein the track system further includes a central conductor located between the rails so that current is supplied through two rails and the central conductor, said sliding bridge being arranged so as to electrically connect said contact pins with one another, and provided with current-collecting means sliding along the central conductor.

* * * * *